US007386267B2

(12) United States Patent
Abe et al.

(10) Patent No.: US 7,386,267 B2
(45) Date of Patent: Jun. 10, 2008

(54) CLEANING BLADE MEMBER AND METHOD FOR PRODUCING THE SAME

(75) Inventors: Shuji Abe, Yokohama (JP); Masahiro Omori, Yokohama (JP); Miyuki Ueno, Yokohama (JP)

(73) Assignee: Synztec Co., Ltd., Tokyo (JP)

( * ) Notice: Subject to any disclaimer, the term of this patent is extended or adjusted under 35 U.S.C. 154(b) by 371 days.

(21) Appl. No.: 11/312,576

(22) Filed: Dec. 21, 2005

(65) Prior Publication Data

US 2006/0140692 A1 Jun. 29, 2006

(30) Foreign Application Priority Data

Dec. 28, 2004 (JP) ..... 2004-381373
Dec. 13, 2005 (JP) ..... 2005-359449

(51) Int. Cl.
*G03G 21/00* (2006.01)

(52) U.S. Cl. ..... 399/350

(58) Field of Classification Search ..... 399/350, 399/343; 528/80, 83, 44
See application file for complete search history.

(56) References Cited

U.S. PATENT DOCUMENTS 5,732,320 A * 3/1998 Domagall et al. ..... 399/350
5,765,088 A * 6/1998 Nakayama et al. ..... 399/350
6,600,003 B2 * 7/2003 Shirasaka et al. ..... 528/80
2001/0018003 A1 * 8/2001 Waterschoot
2002/0021923 A1 * 2/2002 Sato et al. ..... 399/350
2002/0037990 A1 * 3/2002 Hitoshi et al. ..... 528/80

FOREIGN PATENT DOCUMENTS

JP 09281865 A * 10/1997
JP 2003-302802 A 10/2003

* cited by examiner

*Primary Examiner*—Susan Lee
(74) *Attorney, Agent, or Firm*—Sughrue Mion, PLLC

(57) ABSTRACT

The invention provides a cleaning blade member having a controlled friction coefficient and a method for producing the same. The cleaning blade member, for use in a cleaning part for removing toner deposits, is formed of a polyurethane having a ratio of rebound resilience at 25° C. to Young's modulus (rebound resilience at 25° C./Young's modulus) of 4.5 or less.

5 Claims, 4 Drawing Sheets

CLEANING BLADE MEMBER AND METHOD FOR PRODUCING THE SAME

BACKGROUND OF THE INVENTION

1. Field of the Invention

The present invention relates to a cleaning blade member and, more particularly, to a cleaning blade member for removing a toner deposited on a toner image carrier employed in an electrophotographic process-such as a photoconductor or a transfer belt, on which a toner image is formed and which transfers the formed image to an image receptor.

2. Background Art

Generally, in an electrophotographic process, electrophotographic apparatus parts such as an electrophotographic photoreceptor and a transfer belt are used cyclically and repeatedly, and a toner deposited thereon is removed by means of a cleaning blade. Japanese Patent Application Laid-Open (kokai) No. 2003-302802 discloses that members for use in such a cleaning blade are made of polyurethane. Polyurethane is employed because it has excellent wear resistance, exhibits sufficient mechanical strength without incorporating additives such as a reinforcing agent thereinto, and does not stain objects. When a cleaning blade has excessively high friction coefficient, contact between the cleaning blade and an object such as a photoconductor becomes unfavorable. Thus, a variety of measures have been taken for reducing friction coefficient, such as an approach in which a lubricating component is applied to the cleaning blade tip to come into contact with an object; an approach in which a lubricating component is added to polyurethane; an approach in which a lubricating component is incorporated into polyurethane through copolymerization; and an approach in which a lubricating coating material is applied to a polyurethane blade member.

However, these approaches have drawbacks. For example, the approach of applying a lubricating component cannot provide a long-term lubrication effect. When the approach of adding a lubricating component is employed, difficulty is encountered in bonding a blade member to a substrate member, and problematic bleeding of the additive occurs, resulting in staining objects. When a lubricating component is copolymerized with polyurethane, the formed polymer material comes to have unsatisfactory characteristics, resulting in reduced wear resistance and staining of an object by a low-molecular-weight component. In addition, since factors controlling friction coefficient have not been completely elucidated, designing of suitable cleaning blades is difficult.

The present inventors have carried out extensive studies in order to solve the aforementioned problems, and have found that friction coefficient depends on the ratio of Young's modulus to rebound resilience. The present invention has been accomplished on the basis of this finding. Notably, Japanese Patent Application Laid-Open (kokai) No. 2003-302802 discloses a blade member whose physical properties, including Young's modulus and rebound resilience, fall within specific ranges. However, this document does not teach the relationship between friction coefficient and these physical properties.

SUMMARY OF THE INVENTION

Thus, an object of the present invention is to provide a cleaning blade member having a controlled friction-coefficient. Another object of the invention is to provide a method for producing the cleaning blade member.

Accordingly, in a first mode of the present invention, there is provided a cleaning blade member for use in a cleaning part for removing toner deposits, wherein the cleaning blade member is formed of a polyurethane having a ratio of rebound resilience at 25° C. to Young's modulus (rebound resilience at 25° C./Young's modulus) of 4.5 or less.

In the first mode, the polyurethane may have a 200% modulus of 7 MPa or higher, a tear strength of 50 kN/m or higher, and a tan δ (1 Hz) peak temperature of +10° C. or lower.

In the first mode, the polyurethane may have a static friction coefficient of 2.7 or less.

In a second mode of the present invention, there is provided a method for producing a cleaning blade member for use in a cleaning part for removing toner deposits, wherein the method comprises blending a polyol, a polyisocyanate, and a cross-linking agent such that a polyurethane formed therefrom has a ratio of rebound resilience at 25° C. to Young's modulus (rebound resilience at 25° C./Young's modulus) of 4.5 or less.

In the second mode, the polyurethane may have a 200% modulus of 7 MPa or higher, a tear strength of 50 kN/m or higher, and a tan δ (1 Hz) peak temperature of +10° C. or lower.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

Figure 1:
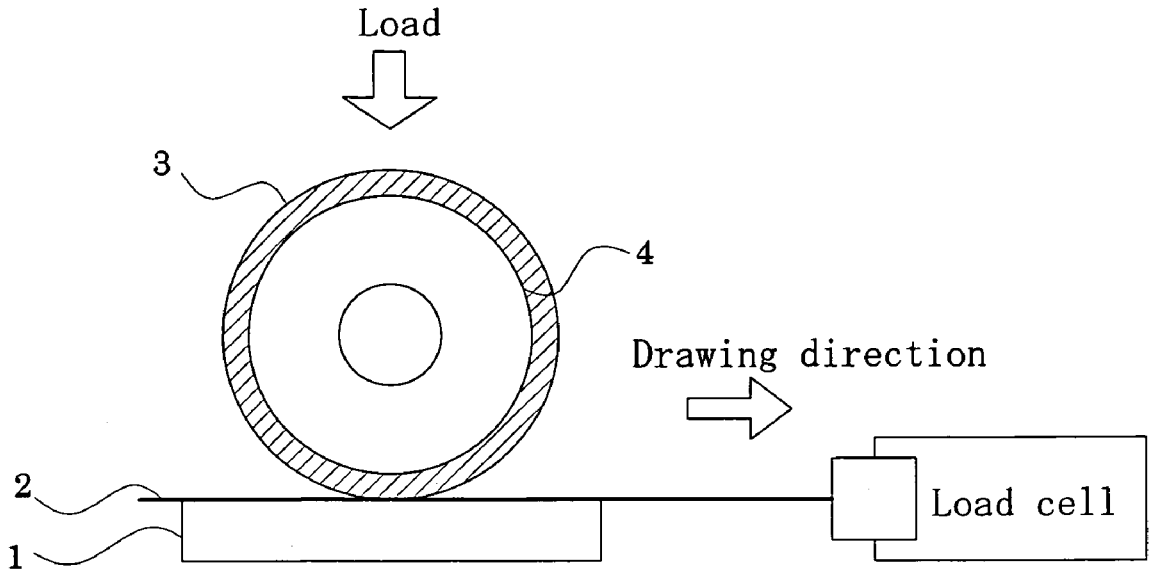
FIG. 1 is a sketch of a friction coefficient measuring apparatus.

The cleaning blade member of the present invention is formed of a polyurethane having a ratio of rebound resilience at 25° C. to Young's modulus (rebound resilience at 25° C./Young's modulus) of 4.5 or less.

Although either Young's modulus itself or rebound resilience itself has no correlation to friction coefficient, the ratio of rebound resilience to Young's modulus is correlated to friction coefficient. Thus, through regulating the rebound resilience/Young's modulus ratio, a cleaning blade member having a desired friction coefficient can be produced. The rebound resilience/Young's modulus ratio has correlations to both static friction coefficient and kinetic coefficient. The correlation of the ratio is higher to static friction coefficient. When the ratio rebound resilience (25° C.) to Young's modulus is regulated to 4.5 or less, the produced cleaning blade member has a static friction coefficient of 2.7 or less and a kinetic friction coefficient of 2.6 or less. When the cleaning blade member has such a low friction coefficient, the member has excellent wear resistance. More preferably, the ratio rebound resilience (25° C.) to Young's modulus is 1.0 to 4.1. The rebound resilience (25° C.) is preferably 10 to 70%, and the Young's modulus is preferably 4 to 30 MPa.

The 200% modulus is preferably 7 MPa or higher. When the 200% modulus is lower than 7 MPa, wear resistance tends to decrease, and chipping of the blade edge and image failures such as blank spots occur after operation of smaller numbers of paper sheets.

The tear strength is preferably 50 kN/m or higher. When the tear strength is 50 kN/m or higher, the produced cleaning blade exhibits excellent wear resistance.

The tensile strength (23° C.) is preferably 20 MPa or higher. When the tensile strength is lower than 20 MPa, wear resistance decreases.

The tan δ (1 Hz) peak temperature is preferably +10° C. or lower. When the tan δ (1 Hz) peak temperature is higher than +10° C., the formed polyurethane assumes hard resin within a temperature range for-use, readily resulting in cracking, chipping, etc.

Preferably, in the present invention, polyurethane has an α value of 0.7 to 1.0. As used herein, the term "α value" refers to a value calculated in accordance with the following equation:

α value=amount (by mol) of OH present in cross-linking agent/(amount (by mol) of NCO remaining after reaction between polyol and isocyanate).

When the α value is greater than 1.0, OH groups remain in the cross-linking agent, and the blade produced from the polyurethane stains an object such as a photoconductor during contact, whereas when the α value is smaller than 0.7, mechanical strength may be poor due to excessively small cross-linking density, or deactivation of remaining isocyanate may require a long time, thereby staining a photoconductor.

The cleaning blade member of the present invention is formed of a polyurethane, which can be produced from a polyol, a polyisocyanate, and a cross-linking agent.

Examples of the polyol include polyester-polyol produced through dehydration condensation between diol and dibasic acid; polycarbonate-polyol produced through reaction between diol and alkyl carbonate; polyol derived from caprolactone; polyether-polyol; and polyoxytetramethylene ether glycol. The polyol is preferably contained in an amount of 60 to 80 wt. % in the polyurethane.

The polyisocyanate to be reacted with the polyol preferably has a non-rigid molecular structure. Examples of such polyisocyanates include 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI). Among them, MDI is particularly preferred. The polyisocyanate is preferably incorporated in an amount of 30 to 80 parts by weight (unless otherwise specified, part(s) denotes part(s) by weight) into 100 parts of the polyurethane. When the amount is less than 30 parts, tensile strength may be poor, whereas when the amount is in excess of 80 parts, permanent elongation increases excessively.

The cross-linking agent is produced from a diol and a triol in combination. No particular limitation is imposed on the type of diol, and examples include propanediol (PD), butanediol (BD), and 3,5-diethylthio-2,4-toluenediamine. No particular limitation is imposed on the type of-triol, and a triol having a molecular weight of 120 to 2,500 is preferred, with a triol having a molecular weight of 120 to 1,000 being more preferred; Specific examples include short-chain triols such as trimethylolethane (TME), trimethylolpropane (TMP); and caprolactone-based triols (triols synthesized from ε-caprolactone) having a higher molecular weight and represented by the following formula:

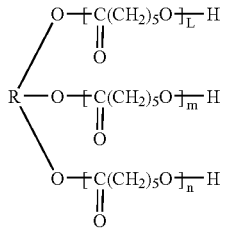

(1)

wherein R represents an alkyl group. The triol is employed as an ingredient of the cross-linking agent in order to improve characteristics of polyurethane such as creep and stress relaxation. No particular limitation is imposed on the amount of a predominant ingredient of the cross-linking agent, and the ratio of diol to triol is preferably 50:50 to 95:5 (diol:triol), more preferably 60:40 to 90:10. Needless to say, diol and triol may each be used in combination of two or more species.

To the aforementioned polyol and the cross-linking agent, a polyisocyanate is added, and the mixture is allowed to react, whereby a polyurethane can be produced. In order to adjust the ratio of rebound resilience (25° C.)/Young's modulus to 4.5 or less, amount-related factors such as amount of isocyanate (parts) and the diol/triol ratio may be modified. Types of reaction generally employed in production of polyurethane such as the prepolymer method and the one-shot method may be employed. In the present invention, the prepolymer method is preferred, since a polyurethane having excellent mechanical strength and wear resistance can be produced. However, in the present invention no limitation is imposed on the reaction type for production of polyurethane. The thus-produced polyurethane pieces are subjected to cutting or a similar process, to thereby form cleaning blade members having predetermined dimensions. Through bonding each cleaning blade member to a support member by use of an adhesive or a similar agent, a cleaning blade product is fabricated.

EXAMPLES

Example 1

Poly(ε-caprolactone)-based diol (molecular weight: 2,000) serving as a polyol (100 parts), MDI (50 parts), and a 1,4-butanediol/trimethylolpropane mixture (70/30) liquid serving as a cross-linking agent were formulated such that a value was adjusted to 0.95. MP-4 (monobutyl phosphate, vulcanization retarder, product of Daihachi Chemical Industry, Co., Ltd.) (0.05 parts) was added to the mixture. The mixture was allowed to react, to thereby form a polyurethane, from which test samples (i.e., cleaning blade members) and cleaning blades were produced. The polyol content of the polyurethane was adjusted to about 60 wt. %.

Example 2

The procedure of Example 1 was repeated, except that a polyester diol (molecular weight: 2,000) (100 parts) produced from a 1,9-nonanediol (ND)/2-methyl-1,8-octanediol (MOD) mixture (65/35) and adipic acid was employed as a polyol, and a 1,3-propanediol/trimethylolethane mixture (70/30) liquid was employed as a cross-linking agent, to thereby produce test samples and cleaning blades.

Example 3

The procedure of Example 1 was repeated, except that a polycarbonate diol (molecular weight: 2,000) derived from 1,6-hexanediol and a polyester diol (molecular weight: 2,000) produced from a 1,9-nonanediol/2-methyl-1,8-octanediol mixture (65/35) and adipic acid were employed in a total amount of 100 parts (1:1 by mole) as polyols, a 1,3-propanediol/trimethylolethane mixture (80/20) liquid was employed as a cross-linking agent, and MDI was used in an amount of 40 parts, to thereby produce test samples and cleaning blades.

Example 4

The procedure of Example 3 was repeated, except that poly(ε-caprolactone)-based diol (molecular weight: 2,000) was used instead of the polyester diol (molecular weight: 2,000) produced from adipic acid and a 1,9-nonanediol/2-methyl-1,8-octanediol mixture, and the cross-linking agent balance (diol/triol) was adjusted to 70/30, to thereby produce test samples and cleaning blades.

Example 5

Poly(ε-caprolactone)-based diol (molecular weight: 2,000) serving as a polyol (100 parts), MDI (15 parts), TODI (25 parts), and a 3,5-diethylthio-2,4-toluenediamine (Ethacure, product of Albemarle Corporation)/trimethylolpropane mixture (60/40) liquid serving as a cross-linking agent were formulated such that α value was adjusted to 0.95. MP-4 (monobutyl phosphate, vulcanization retarder, product of Daihachi Chemical Industry, Co., Ltd.) (0.05 parts) was added to the mixture. The mixture was allowed to react, to thereby form a polyurethane, from which test samples and cleaning blades were produced. The polyol content of the polyurethane was adjusted to about 60 wt. %.

Example 6

The procedure of Example 5 was repeated, except that MDI (20 parts) and TODI (30 parts) were used, to thereby produce test samples and cleaning blades.

Example 7

The procedure of Example 1 was repeated, except that polyoxytetramethylene ether glycol (PTMG) (molecular weight: 1,650) (100 parts) serving as a polyol, a 1,4-butanediol/3,5-diethylthio-2,4-toluenediamine mixture (90/10) liquid serving as a diol component of the cross-linking agent, and MDI (60 parts) were used, and the triol content of the cross-linking agent was adjusted to 0.10, to thereby produce test samples and cleaning blades.

Comparative Example 1

The procedure of Example 2 was repeated, except that MDI (45 parts) was used, and the cross-linking agent balance (diol/triol) was adjusted to 80/20, to thereby produce test samples and cleaning blades.

Comparative Example 2

The procedure of Example 1 was repeated, except that the cross-linking agent balance (diol/triol) was adjusted to 80/20, to thereby produce test samples and cleaning blades.

Comparative Example 3

The procedure of Example 3 was repeated, except that a polycarbonate diol (molecular weight: 2,000) derived from 1,6-hexanediol was used as a single polyol component, and a 1,3-propanediol/caprolactone-based triol (molecular weight: 800) mixture (70/30) liquid was employed as a cross-linking agent, to thereby produce test samples and cleaning blades.

Test Example 1

The following physical properties of the test samples of Examples 1 to 7 and Comparative Examples 1 to 3 were determined. Young's modulus (23° C., 25% elongation) was determined in accordance with JIS K6254. Tensile strength at 100% elongation (100% modulus), tensile strength at 200% elongation (200% modulus), tensile strength at 300% elongation (300% modulus), tensile strength, and elongation at break were determined in accordance with JIS K6251. Tear strength was determined in accordance with JIS K6252. Rebound resilience (Rb) at 25° C. was determined by means of a Lubke pendulum rebound resilience tester in accordance with JIS K6255. Peak temperature of tan δ (1 Hz) was determined by means of a thermal analyzer, EXSTAR 6000DMS viscoelastic spectrometer (product of Seiko Instruments Inc.). The results are shown in Table 1.

Test Example 2

Static and kinetic friction coefficients of the test samples of the Examples and the Comparative Examples were determined by means of an apparatus shown in FIG. 1. Specifically, a polycarbonate sheet 2 (CFEM, product of Mitsubishi Engineering-Plastics Corporation, thickness: 0.25 mm, 10 mm×300 mm) was placed on a Teflon® sheet 1. Each test sample 3 (each of the test samples of the Examples and the Comparative Examples) (thickness: 2 mm, 50 mm×150 mm) was wound around a free roller 4 made of Teflon®. The thus-treated free roller 4, which was rotatably sustained, was pressed against the polycarbonate sheet 2 at a load of 100 g.

When the polycarbonate sheet 2 was conveyed at a drawing rate of 50 mm/sec, the load Q (N) was determined by means of a load cell attached at one terminal end of the polycarbonate sheet 2. Static and kinetic friction coefficients were calculated from the load Q value according to the following equation.

$$\text{Friction coefficient } \mu = Q(N)/(100\ gf \times 0.0098)$$

Figure 2:
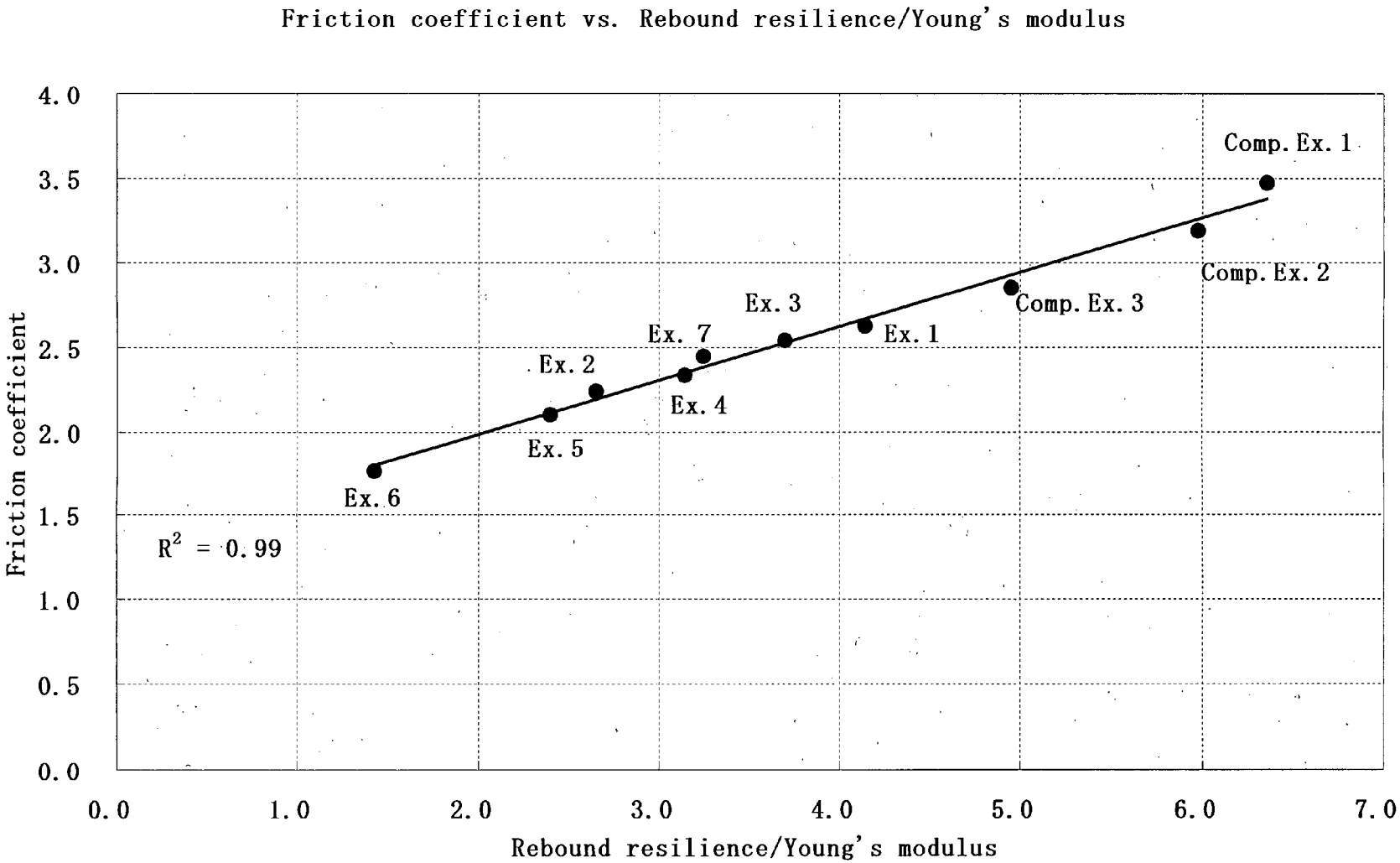
FIG. 2 is a graph showing the relationship between static friction coefficient and rebound resilience (25° C.)/Young's modulus.
Figure 3:
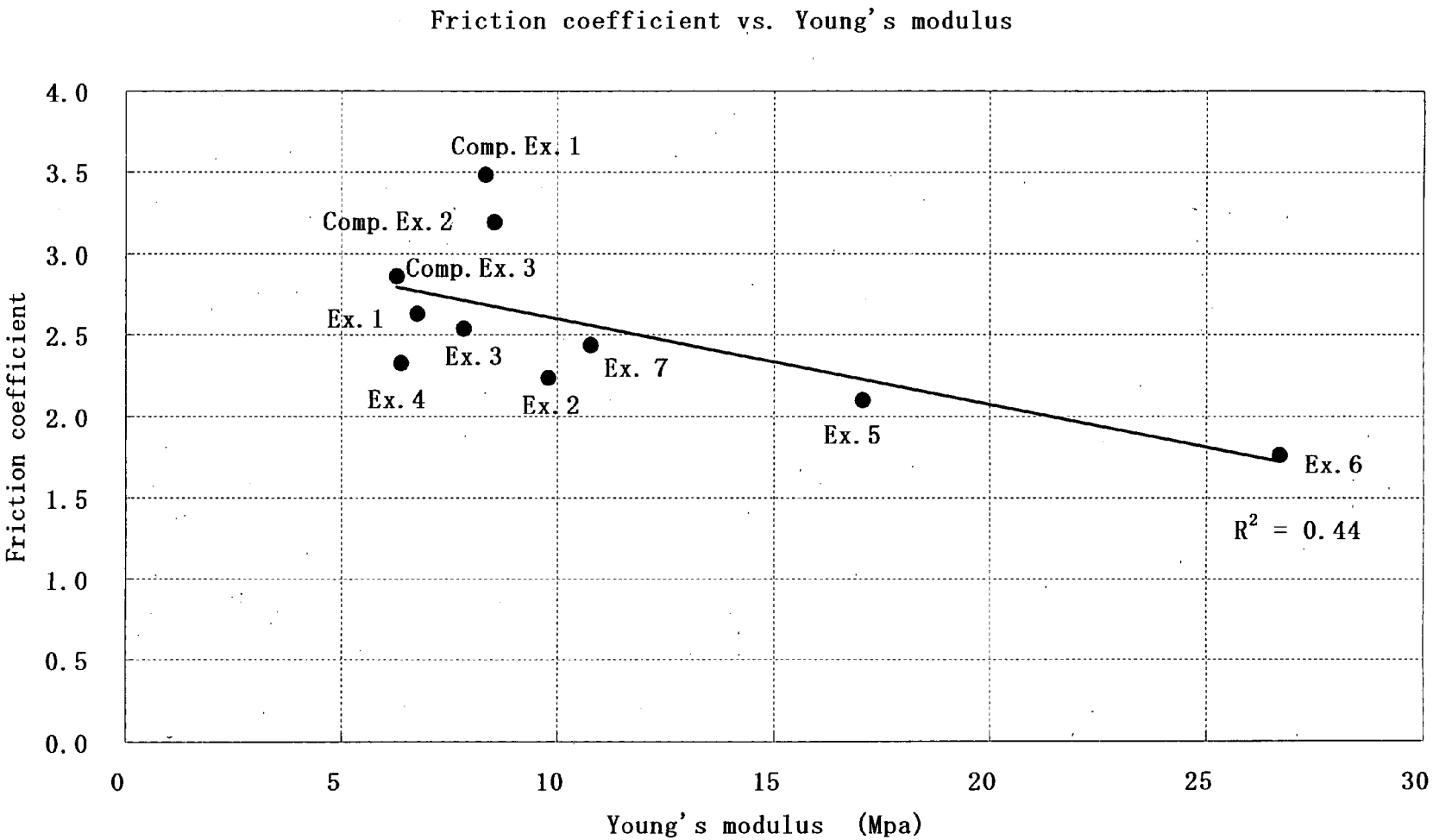
FIG. 3 is a graph showing the relationship between static friction coefficient and Young's modulus.
Figure 4:
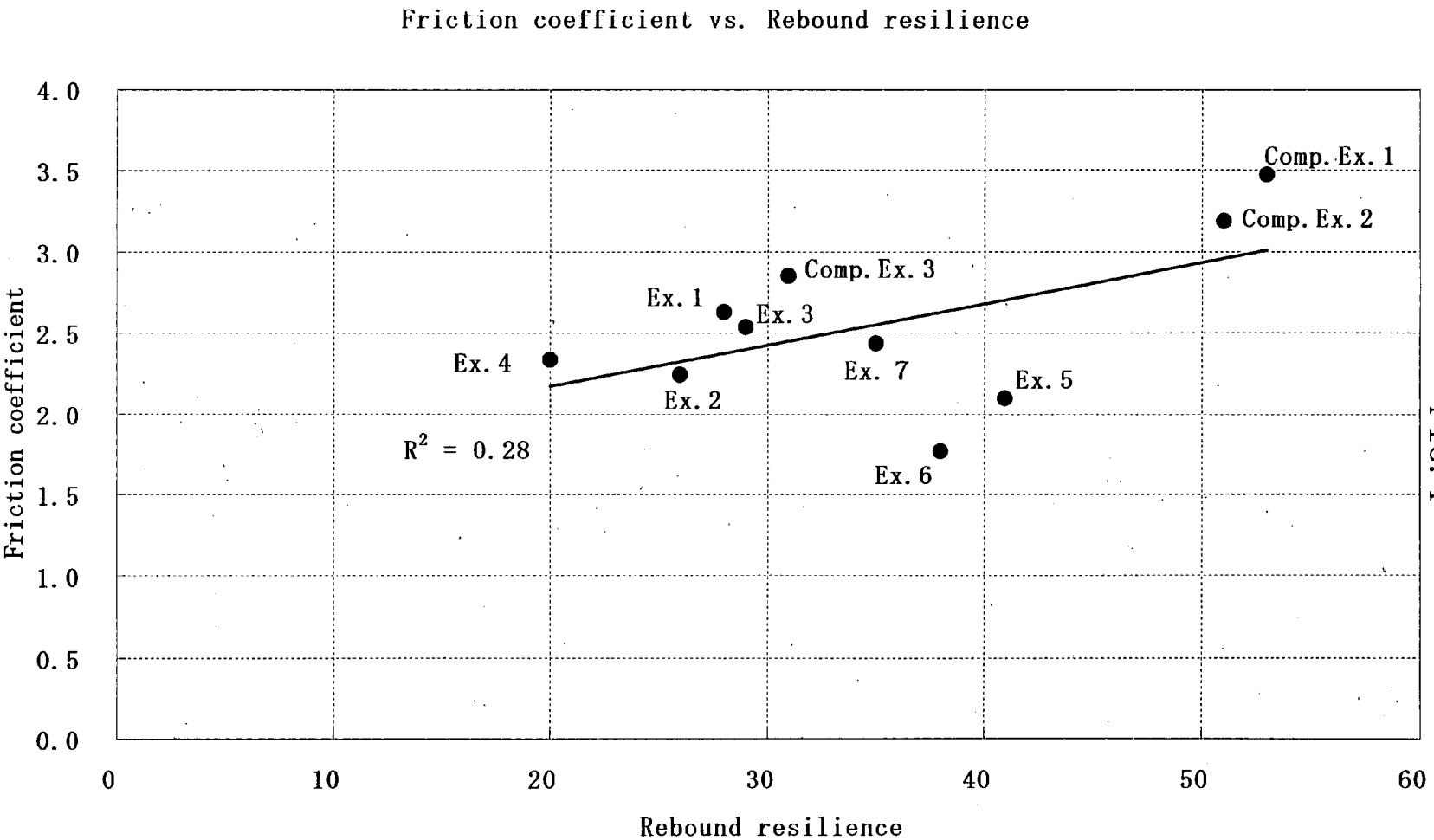
FIG. 4 is a graph showing the relationship between static friction coefficient and rebound resilience.

The above measurement was carried out under ambient temperature and humidity conditions (NN: 23° C., 50% RH). The results are shown in Table 1. FIGS. 2 to 4 show the profiles of static friction coefficients as plotted with respect to rebound resilience/Young's modulus, Young's modulus, and rebound resilience (at 25° C.), respectively.

As is clear from Table 1 and FIGS. 2 to 4, Young's modulus and rebound resilience have no correlation with friction coefficient, whereas rebound resilience (25° C.)/Young's modulus ratio has clear correlation with friction coefficient. Friction coefficient has dependency on rebound resilience (25° C.)/Young's modulus ratio. Notably, as compared with kinetic friction coefficient, static friction coefficient has higher correlation with rebound resilience (25° C.)/Young's modulus ratio.

<Test Conditions>

Press conditions; Abutting angle: 25°, Pressure: 3 gf/cm
Photoconductor; OPC (coated with initial lubricant)

Charging conditions;
Voltage: Vd/−750 V, VI/−50 V
(AC: Vpp/2.0 kV, 1.5 kHz (sine wave),
DC offset: −900 V input)

Laser microscopy conditions;
Microscope: VK-9500 (KEYENCE Corporation), magnification: ×50
Mode: Ultra-depth color profiling
Optical zoom: ×1.0
Measurement pitch: 0.10 μm
Measurement points: 5 points per cleaning blade (i.e., points 20 mm from the respective ends, points 80 mm from the respective ends, and the center point)

As is clear from Table 1, the cleaning blades of Examples 1 to 7, having a rebound resilience (25° C.)/Young's modulus rate of 4.5 or lower and a static friction coefficient of 2.7 or lower, exhibited edge wear of 10 μm or less and generated virtually no squeaky sounds. In contrast, the cleaning blades of Comparative Examples 1 to 3, having a rebound resilience (25° C.)/Young's modulus ratio greater than 4.5 and an increased static friction coefficient, exhibited large edge wear and generated squeaky sounds under HH conditions.

TABLE 1(1-A)

| | | Ex. 1 | Ex. 2 | Ex. 3 | Ex. 4 | Ex. 5 | Ex. 6 | Ex. 7 |
|---|---|---|---|---|---|---|---|---|
| Polyol | A | caprolactone | 1,9-ND MOD adipate | 1,6-HD carbonate | 1,6-HD carbonate | caprolactone | caprolactone | PTMG |
| | B | — | — | 1,9-ND MOD adipate | caprolactone | — | — | — |
| | Balance | 100% | 100% | 50% | 50% | 100% | 100% | 100% |
| Isocyanate | parts | 50 | 50 | 40 | 40 | 40 | 50 | 60 |
| Cross-linking agent | Diol | BD | PD | PD | PD | EC | EC | BD/EC |
| | Triol | TMP | TME | TMP | TMP | TMP | TMP | TMP |
| | Trifunction | 0.30 | 0.30 | 0.20 | 0.30 | 0.40 | 0.40 | 0.10 |

Test Example 3

Each of the cleaning blades of the Examples and the Comparative Examples was pressed against a photoconductor, and the photoconductor was continuously rotated at a circumferential speed of 125 mm/sec for 60 minutes under LL conditions (10° C., 30%) or HH conditions (30° C., 85%), while no paper sheet was conveyed. After completion of the operation, the wear condition of an edge portion of the cleaning blade was observed under a laser microscope, and the amount of wear was microscopically determined. The wear was evaluated by average cross-section area of wear portions in accordance with the following ratings: O (0 to 10 $\mu m^2$), Δ (11 to 20 $\mu m^2$), and X (≧21 $\mu m^2$). In the case of the test operation performed under the HH conditions, generation of squeaky sounds was aurally checked. The squeaky sound generation was evaluated in accordance with the ratings: O (no squeaky sounds generated) and X (squeaky sounds generated). The above tests were performed under the following conditions, and the results are shown in Table 1.

TABLE 1(1-B)

| | | Comp. Ex. 1 | Comp. Ex. 2 | Comp. Ex. 3 |
|---|---|---|---|---|
| Polyol | A | 1,9-ND MOD adipate | caprolactone | 1,6-HD carbonate |
| | B | — | — | — |
| | Balance | 100% | 100% | 100% |
| Isocyanate | part | 45 | 50 | 40 |
| Cross-linking agent | Piol | PD | BD | PD |
| | Triol | TME | TMP | caprolactone-derived |
| | Trifunction | 0.20 | 0.20 | 0.30 |

TABLE 1 (2-a)

| | | | Ex. 1 | Ex. 2 | Ex. 3 | Ex. 4 | Ex. 5 | Ex. 6 | Ex. 7 |
|---|---|---|---|---|---|---|---|---|---|
| Friction characteristics | | Static friction coefficient | 2.6 | 2.2 | 2.5 | 2.3 | 2.1 | 1.8 | 2.4 |
| | | Kinetic friction coefficient | 2.6 | 2.0 | 2.3 | 2.1 | 1.9 | 1.5 | 2.1 |
| Physical properties | Rebound resilience | 0/0 at 25° C. | 28 | 26 | 29 | 20 | 41 | 38 | 35 |
| | Young's modulus | MPa | 7 | 10 | 8 | 6 | 17 | 27 | 11 |
| | Rebound resilience/Young's modulus | | 4.1 | 2.7 | 3.7 | 3.1 | 2.4 | 1.4 | 3.2 |
| | tanδ Peak Temperature (1 Hz) | | −8 | 4 | 0 | 4 | −15 | −8 | −20 |
| | 100% Modulus | MPa | 4 | 9 | 6 | 5 | 9 | 15 | 7 |
| | 200% Modulus | MPa | 7 | 20 | 13 | 11 | 14 | 25. | 12 |
| | 300% Modulus | MPa | *note | *note | 32 | 36 | 25 | 24 | 21 |
| | Tensile strength | MPa | 29 | 39 | 48 | 45 | 51 | 47 | 34 |
| | Elongation | % | 300 | 260 | 330 | 310 | 410 | 300 | 36 |
| | Tear strength | kN/m | 54 | 74 | 74 | 59 | 103 | 103 | 93 |
| Accelerated tests | Wear test (HH) | | ○ | ○ | ○ | ○ | ○ | ○ | ○ |
| | Wear test (LL) | | ○ | ○ | ○ | ○ | ○ | ○ | ○ |
| | Squeak sound check (HH) | | ○ | ○ | Δ | ○ | ○ | ○ | ○ |

*note: Unmeasurable, broken before 300% elongation

TABLE 1 (2-b)

| | | | Comp. Ex. 1 | Comp. Ex. 2 | Comp. Ex. 3 |
|---|---|---|---|---|---|
| Friction characteristics | | Static friction coefficient | 3.5 | 3.2 | 2.9 |
| | | Kinetic friction coefficient | 2.8 | 2.9 | 2.6 |
| Physical properties | Rebound resilience | % at 25° C. | 53 | 51 | 31 |
| | Young's modulus | MPa | 8 | 9 | 6 |
| | Rebound resilience/young's modulus | | 6.4 | 6.0 | 5.0 |
| | tanδ Peak Temperature (1 Hz) | | −5 | −7 | 2 |
| | 100% Modulus | MPa | 5 | 4 | 4 |
| | 200% Modulus | MPa | 10 | 8 | 8 |
| | 300% Modulus | MPa | 23 | 15 | 25 |
| | Tensile strength | MPa | 39 | 33 | 46 |
| | Elongation | % | 360 | 330 | 340 |
| | Tear strength | kN/m | 88 | 69 | 64 |
| Accelerated tests | Wear test (HH) | | X | X | X |
| | Wear test (LL) | | ○ | ○ | ○ |
| | Squeak sound check (HH) | | X | X | Δ |

According to the present invention, friction coefficient of polyurethane forming the cleaning blade member can be controlled by regulating the ratio of rebound resilience to Young's modulus.

What is claimed is:

1. A cleaning blade member for use in a cleaning part for removing toner deposits, wherein the cleaning blade member is formed of a polyurethane having a ratio of rebound resilience at 25° C. to Young's modulus (rebound resilience at 25° C./Young's modulus) of 4.5 or less.

2. A cleaning blade member according to claim 1, wherein the polyurethane has a 200% modulus of 7 MPa or higher, a tear strength of 50 kN/m or higher, and a tan δ (1 Hz) peak temperature of +10° C. or lower.

3. A cleaning blade member according to claim 1, wherein the polyurethane has a static friction coefficient of 2.7 or less.

4. A method for producing a cleaning blade member for use in a cleaning part for removing toner deposits, wherein the method comprises blending a polyol, a polyisocyanate, and a cross-linking agent such that a polyurethane formed therefrom has a ratio of rebound resilience at 25° C. to Young's modulus (rebound resilience at 25° C./Young's modulus) of 4.5 or less.

5. A method for producing a cleaning blade member according to claim 4, wherein the polyurethane has a 200% modulus of 7 MPa or higher, a tear strength of 50 kN/m or higher, and a tan δ (1 Hz) peak temperature of +10° C. or lower.

* * * * *